US008540117B2

(12) United States Patent
Andrews et al.

(10) Patent No.: US 8,540,117 B2
(45) Date of Patent: Sep. 24, 2013

(54) COMPARTMENTALIZED PORTABLE CONTAINER AND BODY WASH WIPES

(76) Inventors: Connie M Andrews, Dayton, OH (US); Timothy B Andrews, Dayton, OH (US)

( * ) Notice: Subject to any disclaimer, the term of this patent is extended or adjusted under 35 U.S.C. 154(b) by 204 days.

(21) Appl. No.: 13/156,115

(22) Filed: Jun. 8, 2011

(65) Prior Publication Data

US 2012/0091164 A1 Apr. 19, 2012

Related U.S. Application Data

(60) Provisional application No. 61/392,659, filed on Oct. 13, 2010.

(51) Int. Cl.
*B65D 83/08* (2006.01)

(52) U.S. Cl.
USPC ..... 221/35; 221/34; 221/46; 221/47

(58) Field of Classification Search
USPC ..... 221/33, 34, 35, 45, 46, 47
See application file for complete search history.

(56) References Cited

U.S. PATENT DOCUMENTS

| | | | | |
|---|---|---|---|---|
| 3,459,329 | A * | 8/1969 | Mochizuki et al. | 221/34 |
| 4,469,243 | A * | 9/1984 | Ito et al. | 221/34 |
| D331,074 | S * | 11/1992 | Dotterman et al. | D19/86 |
| 5,687,875 | A * | 11/1997 | Watts et al. | 221/45 |
| 6,382,551 | B1 * | 5/2002 | Nelson | 242/594.1 |
| 7,568,594 | B2 * | 8/2009 | Long | 221/63 |
| 7,954,634 | B2 * | 6/2011 | Blakeman | 206/233 |
| 2008/0272016 | A1 * | 11/2008 | Anderson et al. | 206/233 |

* cited by examiner

*Primary Examiner* — Patrick Mackey
(74) *Attorney, Agent, or Firm* — Sinorica, LLC

(57) ABSTRACT

The present invention is a compartmentalized portable container and body wash wipes, which allows the user to substitute the traditional showering or bathing cycle with a series of body wipes. These body wipes are carried in a slender container, which allows the present invention to be a very portable device. The series of wipes include a number of pre-wash wipes, soap wipes, moisturizing wipes, and deodorizing wipes. Once the user finishes the series of wipes, the user throws the wipes away. The container stores and separate each kind of wipe in their own compartment. The dispensing mechanisms on the container allows the user to take only one of each kind of wipe at a time. The present invention can also be cleaned out with warm soapy water or alcohol once the supply of body wipes has been exhausted, which provides a replacement pack of body wipes with a clean container.

15 Claims, 8 Drawing Sheets

COMPARTMENTALIZED PORTABLE CONTAINER AND BODY WASH WIPES

The current application claims a priority to the U.S. Provisional Patent application Ser. No. 61/392,659 filed on Oct. 13, 2010.

FIELD OF THE INVENTION

The present invention relates generally to a container which holds and dispenses body wipes. Specifically, its objective is to provide the user a compartmentalized container which dispenses a plurality of different types of body wipes to thoroughly clean one's body.

BACKGROUND OF THE INVENTION

Traditionally, bathing or showering is done in the comforts of one's home in a bathroom environment. As bathing or showering requires a large amount of water, soaps and other cleaning materials, and a shower or bathtub, cleansing of one's body must generally be carried out in a specified location dedicated to this process. Because of this, the process is limited to bathrooms and furthermore requires a significant amount of time on behalf of the person. To begin the traditional process, one must rinse his or her body under water before applying soap. One then lathers the body with soap and water to kill germs and lift up dirt. Once the user is comfortable with the dirt removed from one's body by the active suds, another rinse cycle is run about the body to clear away the suds. Nearing the cleaning cycle's completion, the user must dry off before completing the primary cleaning process. Additionally, there may be procedures carried out after the cleaning process such as moisturizing the skin with lotions and oils to prevent the skin from drying and aids in a healthy complexion. Currently, there are many commercial wipes and portable containers designed for washing or disinfecting countertops, hard surfaces, dining tables, etc. These single-purpose wipes such as hand or face wipes are highly popular in today's culture where cleanliness plays a huge factor to the emotional psyche within the average household. Single-purpose wipes are stored in a container which houses simply that one type of wipe. If a user requires multiple types of wipes, the user would need to carry around several different containers, each containing their own unique wipe. Furthermore, the purpose of currently available wipes is generally for the purpose of household cleaning or basic hand or face cleaning. There currently is not a product which is intended to be a replacement for the human body cleansing process. It is therefore an objective of the present invention to introduce a compartmentalized portable container capable of housing a plurality of different wipes, each with its own unique purpose and part of a typical human cleansing cycle. When the wipes are used in conjunction with each other, the present invention provides wipes for a user to complete a typical body cleansing cycle that is traditionally carried out in the bathroom shower or bathtub. Using the plurality of wipes of the present invention in series mimics the standard series of steps taken by a user in the shower or bathtub. The user is able to clean one's self without the limitation of location and can carry out the typical cleaning process anywhere the invention is taken.

DETAIL DESCRIPTIONS OF THE INVENTION

All illustrations of the drawings are for the purpose of describing selected versions of the present invention and are not intended to limit the scope of the present invention.

Figure 1:
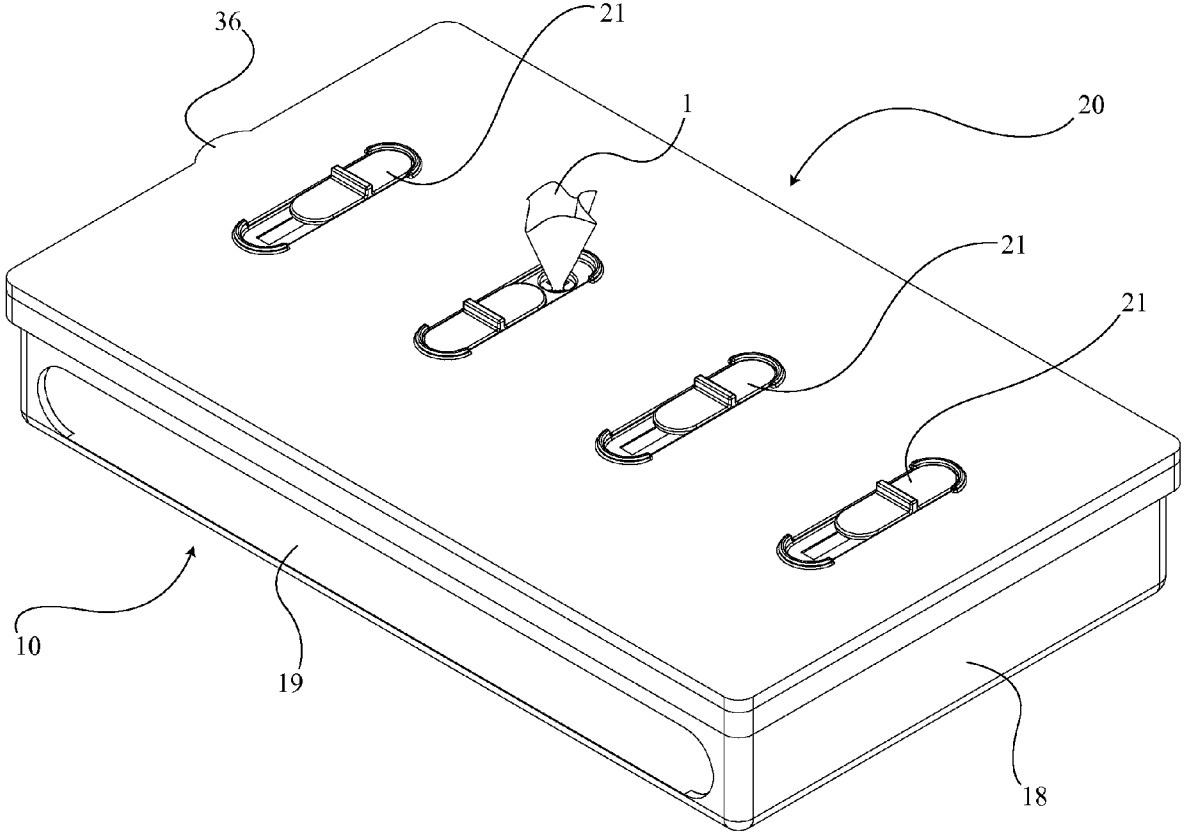
FIG. 1 is a perspective view of the present invention with the top lid attached to the bottom container.
Figure 3:
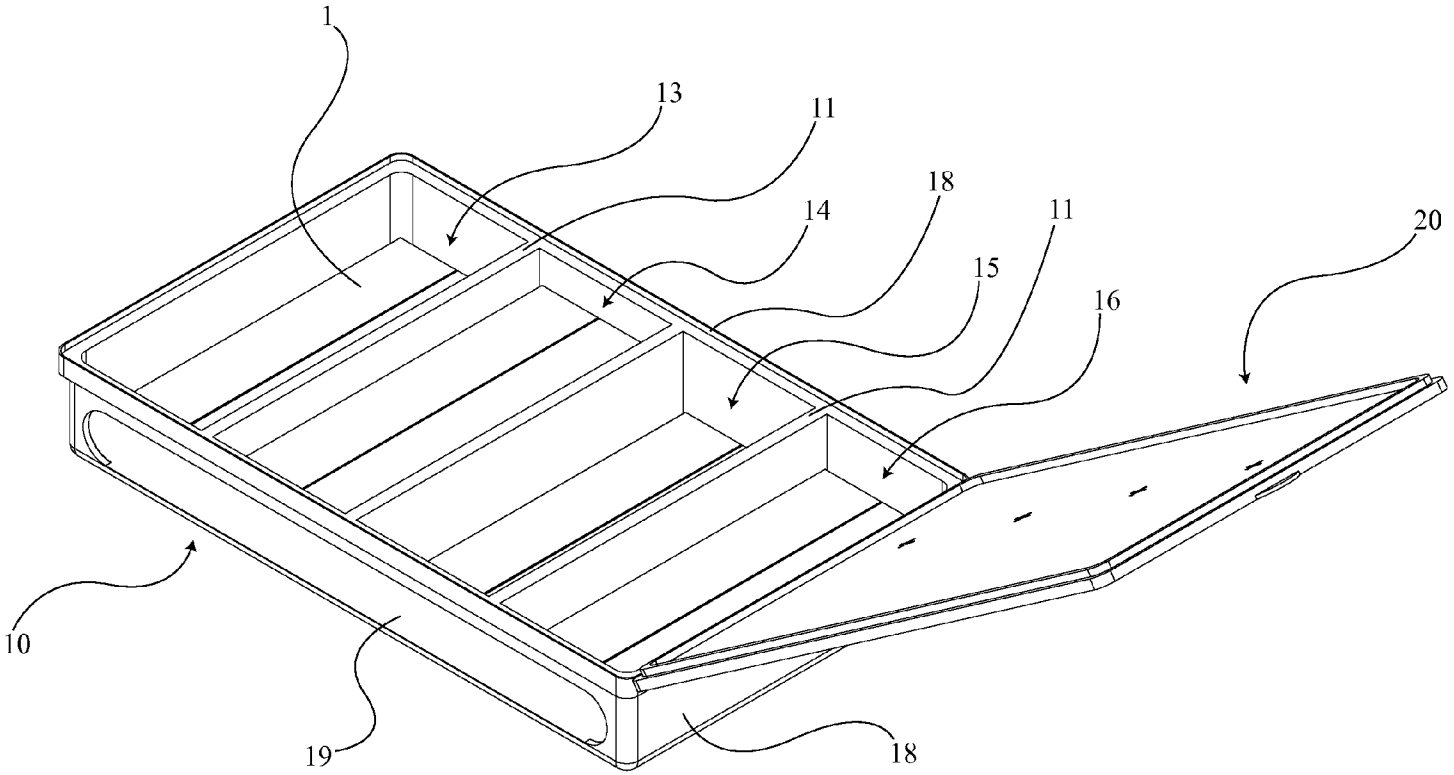
FIG. 3 is a perspective view of the present invention with the top lid detached from the bottom container.

As shown in FIG. 1 and FIG. 3, the present invention is a compartmentalized portable container and body wash wipes, which provides the user with a portable means to wash and clean their body without showering or bathing. The present invention comprises of a plurality of wash cloths 1, a bottom container 10, and a top lid 20. The plurality of wash cloths 1 are used to clean the user's body without a large volume of water. Each of the plurality of wash cloths 1 is thrown away after being used by the user. In the preferred embodiment, the plurality of wash cloths 1 is made of a biodegradable cotton material, which helps to minimize harmful waste into the environment. The bottom container 10 separates and stores the plurality of wash cloths 1. The top lid 20 seals the plurality of wash cloths 1 within the bottom container 10 and prevents the plurality of wash cloths 1 from drying out. The bottom container 10 and top lid 20 are properly sized to provide the user with a portable means to carry the plurality of wash cloths 1 in compact places of storage such as a purse, a backpack, a glove compartment, and a baby bag.

The plurality of wash cloths 1 allows the user to remove dirt and germs from their body with the traditional cleaning cycle. The plurality of wash cloths 1 comprises a number of pre-wash cloths 2, a number of soap cloths 4, a number of moisturizing cloths 6, and a number of deodorizing cloths 8. The present invention allows the user to restock each of the plurality of wash cloths 1 with a plurality of replacement cloths, which is sold separately. Before the plurality of replacement cloths is placed into the bottom container 20 and sealed with the top lid 10, the bottom container 10 and the top lid 20 should washed with warm soapy water or alcohol in order to keep the present invention clean. The number of pre-wash cloths 2 is saturated in a pre-wash solution 3, which allows the user rinse off their body and remove the top layer of dirt and oil from their skin. The pre-wash solution 3 consists of water and cetyl alcohol. The number of pre-wash cloth is a substitute for the preliminary rinse done while bathing or showering during the traditional cleaning cycle. The number of soap cloths 4 is saturated in a soap solution 5, which allows the user to clean and disinfect their skin. The soap solution 5 consists of water, triethanolamine lauryl sulfate, cocamidopropyl betaine, and propylene glycol. The soap solution 5 is antibacterial and evaporates easily to leave no residue on the user's skin, which allows the number of soap cloths 4 to be used without the problem of dripping. After the soap solution 5 is applied by the number of soap cloths 4 on the user's body, the soap solution 4 evaporates off the user's body, which is significant because the user does not need to rinse the soap solution 4 off with water. The number of soap cloths 4 may also be saturated in a soap fragrance consisting of diazolidinyl urea, methylparaben propylparaben, and citric acid. The number of soap cloths 4 is a substitute for the soaping step during the traditional cleaning cycle. In the preferred embodiment, the number of soap cloths 4 has a coarse surface, which is created by a series of ridges, bumps, grooves, or other indentations or protrusions. The coarse surface provides the number of soap cloths 4 with a texture that allows the user to easily scrub the dirt off their body and to trap the dirt within the coarse surface. The number of moisturizing cloths 6 is saturated with a moisturizing solution 7, which allows the user moisturize and add nutrients to their skin. The moisturizing solution 7 consists of citric acid, stearic acid, cocoa butter, glycol stearate, shea butter, collagen, vitamin E, vitamin C, and cetyl alcohol. The number of moisturizing cloths 6 applies and lathers the moisturizing solution 7 onto the user's skin with no liquid residue. The moisturizing solution 7 prevents the user's skin from drying out and protects against damage from the sun, wind, and other external elements. The number of moisturizing cloths 6 is a substitute for applying moisturizer after bathing or showering during the traditional cleaning cycle. The number of deodorizing cloths 8 is saturated with a deodorizing solution 9, which allow the user to mask unwanted odors with a new scent. The deodorizing solution 9 consists of dipropylene glycol, water, propylene glycol, sodium stearate, fragrance, ppg-3 myristyl ether, tetrasodium EDTA, and colors such as violet 2 and green 6. The number of deodorizing cloths 8 allows the user to apply the deodorizing solution 9 to their body, which stay on their skin for the entire day and eliminates unwanted body odors throughout the day. Each of the plurality of replacement cloths packages the number of deodorizing cloths 8 with a different scent so that the user can purchase the number of deodorizing cloths 8 with a preferred fragrance. The number of deodorizing cloths 8 is a substitute for applying deodorant after bathing or showering during the tradition cleaning cycle.

The bottom container 10 allows present invention to store and separate the plurality of wash cloths 1 so that the user can easily access each of the plurality of wash cloths 1. The bottom container 10 comprises of a plurality of dividers 11, a plurality of compartments 12, a bottom surface 17, a plurality of lateral walls 18, and a transparent wall 19. The bottom surface 17 is a base for all other components of the bottom container 10 to connect together and supports the plurality of wash cloths 1 from the bottom. The bottom surface 17 should be appropriately sized so that the number of pre-wash cloths 2, the number of soap cloths 4, the number of moisturizing cloths 6, and the number of deodorizing cloths 8 can properly rest on the bottom surface 17. In the preferred embodiment, the bottom surface 17 would have a rectangular shape. The transparent wall 19 is perpendicularly connected to the edge of the bottom surface 17, which allows the user to look into the bottom container 10. The transparent wall 19 is connected to bottom surface 17 in such a way that the user is able to individually view each of the plurality of wash cloth in order to see if the number of pre-wash cloths 2, the number of soap cloths 4, the number of moisturizing cloths 6, and the number of deodorizing cloths 8 are low. In the preferred embodiment, the transparent wall 19 is perpendicularly connected along the length of the bottom surface 17. The plurality of lateral walls 18 are perpendicularly connected along every edge of the bottom surface 17, except for the edge of the bottom surface 17 connected to the transparent wall 19. The combination of the bottom surface 17, the transparent wall 19, and the plurality of lateral walls 18 form an open container. In the preferred embodiment, the transparent wall 19 and the plurality of lateral walls 18 have a width dictated by the bottom surface 17, but the height of the transparent wall 19 and the plurality of lateral walls 18 should be relatively smaller because the present invention should be able to fit into smaller storage spaces. If the height of the transparent wall 19 and the plurality of lateral walls 18 was relatively large, then the present invention could store more of the plurality of wash cloths 1, but the portability of the present invention would be severely compromised. The plurality of dividers 11 separates the space within the open container created by the combination of the bottom surface 17, the transparent wall 19, and the plurality of lateral walls 18. The plurality of dividers 11 are perpendicularly connected along the area of the bottom surface 17. Depending on the orientation, the plurality of dividers 11 also perpendicularly connect to either the transparent wall 19 and/or the plurality of lateral walls 18. In the preferred embodiment, the plurality of dividers 11 would separate the space with the open container into along the length of the bottom surface 17, where the transparent wall 19 allows the user to look at each of the plurality of dividers 11. The plurality of compartments 12 is formed by the plurality of dividers 11 and allows the present invention to store and separate the plurality of wash cloths 1. In the preferred embodiment, the plurality of compartments 12 is four rectangular spaces separated by three dividers and lie adjacent to each other along their lengths.

Figure 5:
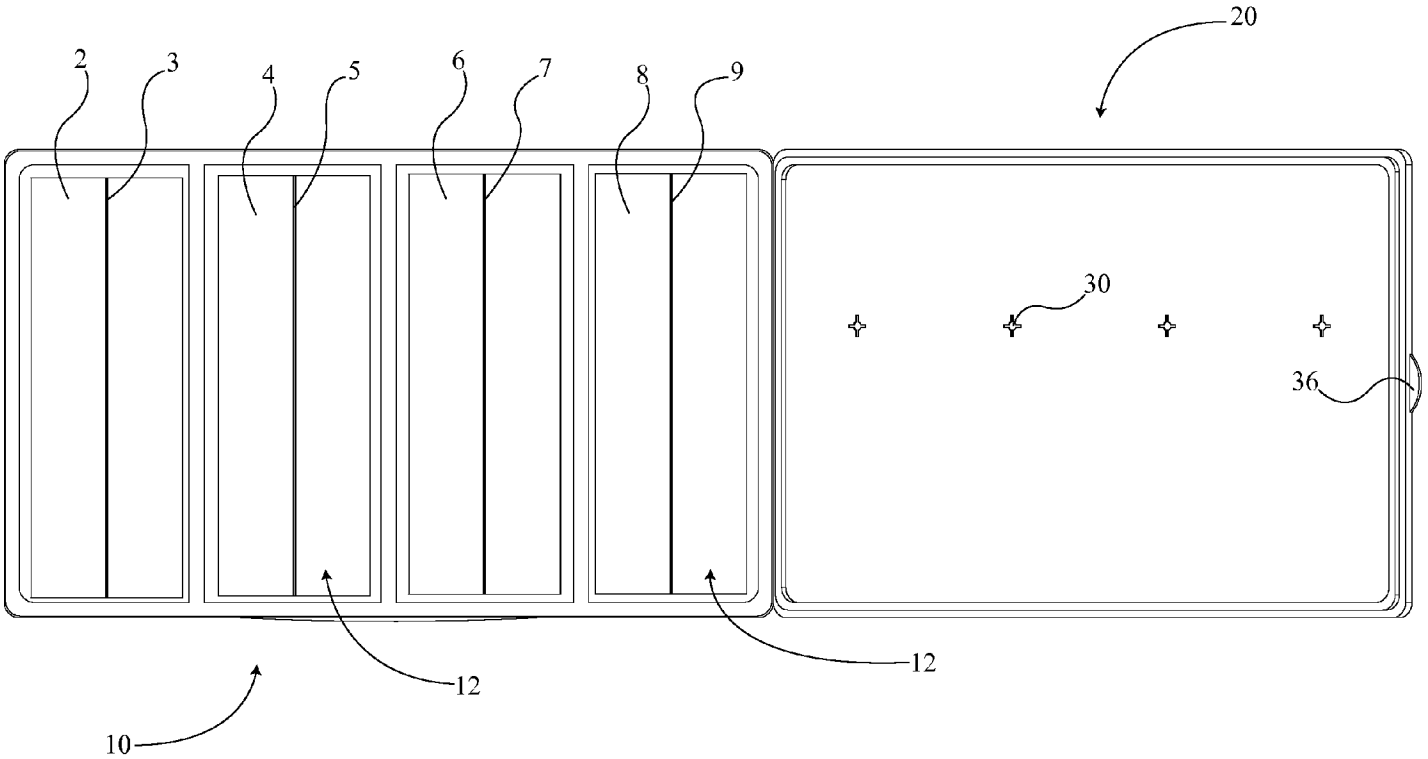
FIG. 5 is a top view of the present invention with the top lid detached from the bottom container.

The plurality of compartments 12 allow the present invention to store and separate the different kinds of wash cloths, which is illustrated in FIG. 5. The plurality of compartments 12 comprises a pre-wash cloth compartment 13, a soap cloth compartment 14, a moisturizing cloth compartment 15, and a deodorizing cloth compartment 16. The pre-wash cloth compartment 13 provides an area to store the number of pre-wash cloths 2. The soap cloth compartment 14 provides an area to store the number of soap cloths 4. The moisturizing cloth compartment 15 provides an area to store the number of moisturizing cloths 6. The deodorizing cloth compartment 16 provides an area to store the number of deodorizing cloths 8. In the preferred embodiment, the plurality of compartments 12 would be positioned adjacent to each other in the following order: the pre-wash cloth compartment 13, the soap cloth compartment 14, the moisturizing cloth compartment 15, and the deodorizing cloth compartment 16.

Figure 2:
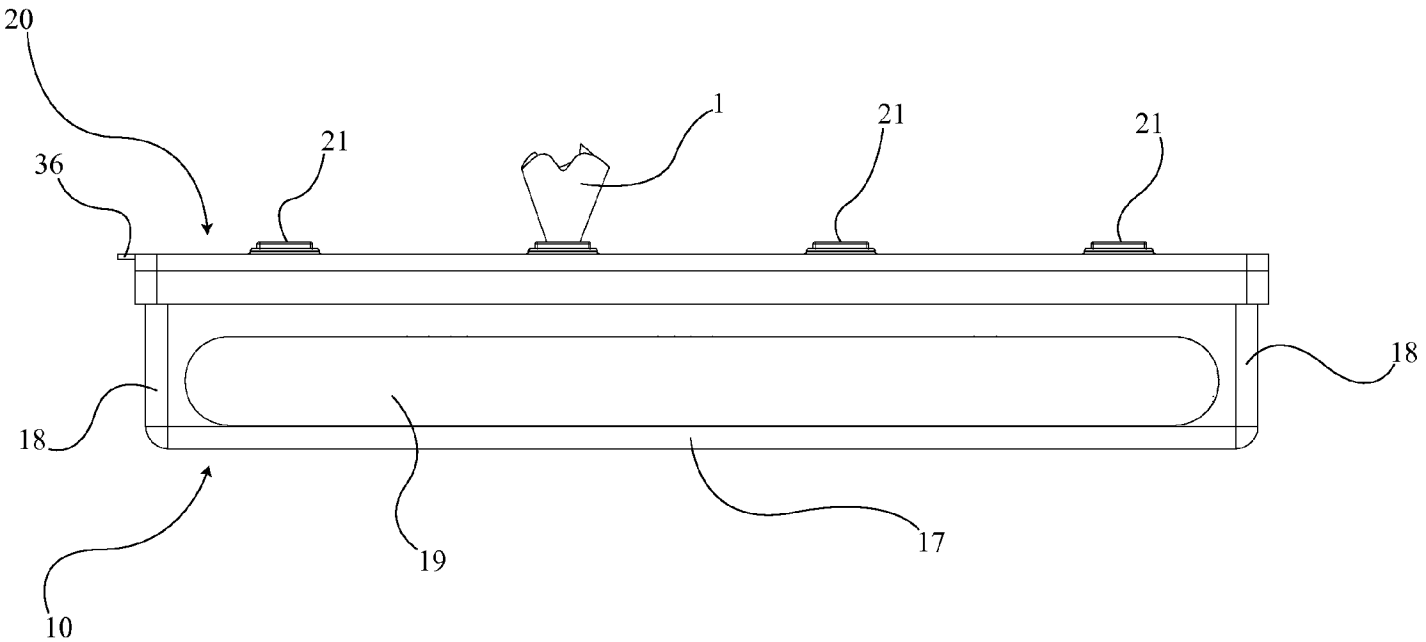
FIG. 2 is a side view of the present invention featuring the transparent wall with the top lid attached to the bottom container.
Figure 4:
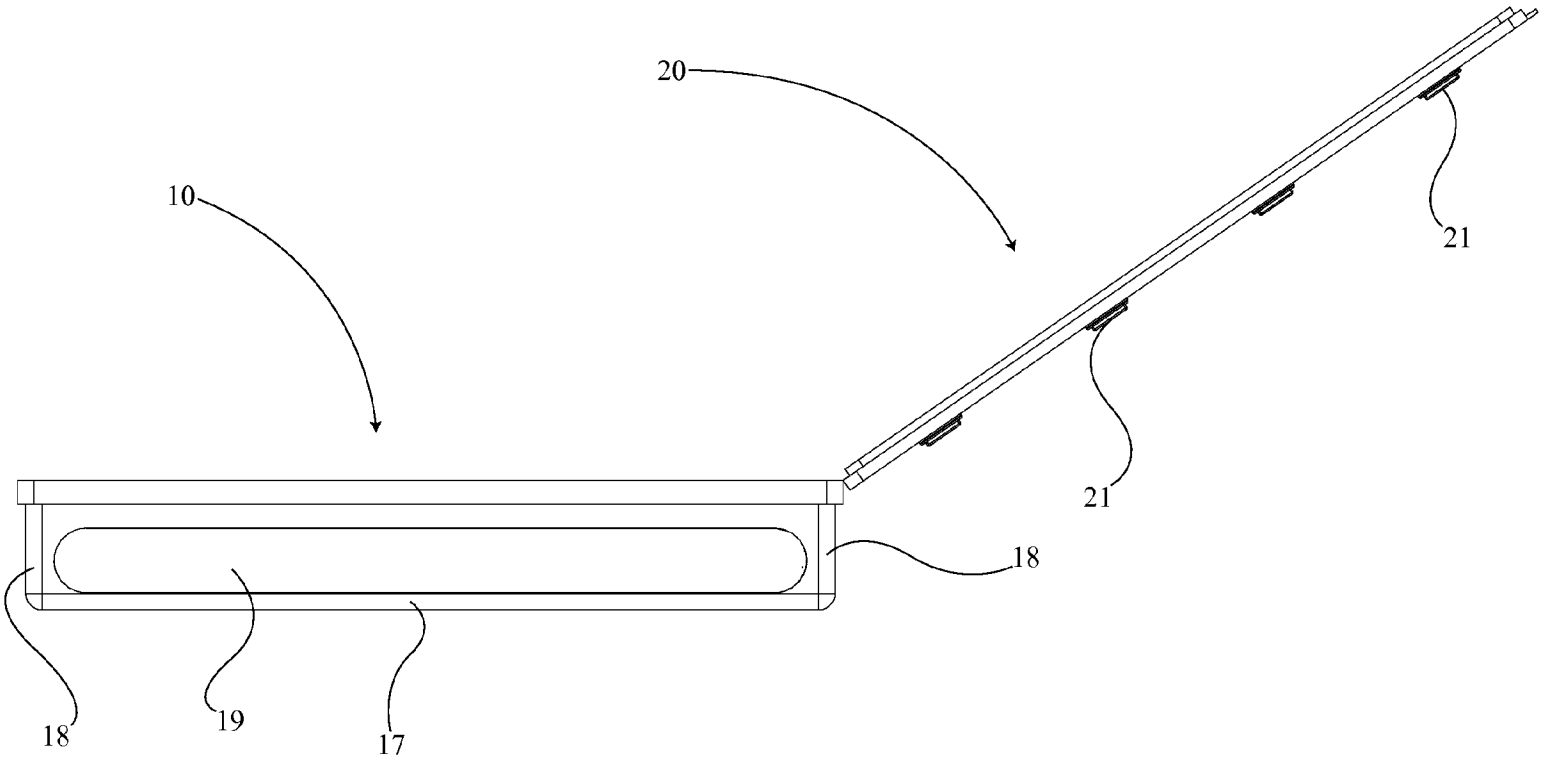
FIG. 4 is a side view of the present invention featuring the transparent wall with the top lid detached from the bottom container.

The top lid 20 provides the present invention with a cover for the bottom container 10. Once the top lid 20 is attached and covers the bottom container 10, the top lid 20 prevents the pre-wash solution 3, the soap solution 5, the moisturizing solution 7, and the deodorizing solution 9 from evaporating out of the plurality of wash cloths 1. When the user places the present invention in a storage compartment, the top lid 20 prevents the plurality of wash cloths 1 from falling out of the plurality of compartments 12 because the bottom container 10 is an open container and not a closed container. The top lid 20 also allows the present invention to dispense the plurality of wash cloths 1 by having a plurality of dispensing mechanisms 21. The plurality of dispensing mechanisms 21 comprises a pre-wash cloth dispensing mechanism 22 located above the pre-wash cloth compartment 13, a soap cloth dispensing mechanism 23 located above the soap cloth compartment 14, a moisturizing cloth dispensing mechanism 24 located above the moisturizing cloth compartment 15, and a deodorizing cloth dispensing mechanism 25 located above the moisturizing cloth compartment 15. In addition, the present invention allows the user to remove the top lid 20 from the bottom container 10 with a separation tab 36, which is a protrusion that the user can grasp and apply a force to separate the top lid 20 from the bottom container 10. From a side view, the separator tab allows the user to remove the top lid 20 from the bottom container 10 in the manner shown in FIG. 2 and FIG. 4.

Figure 6:
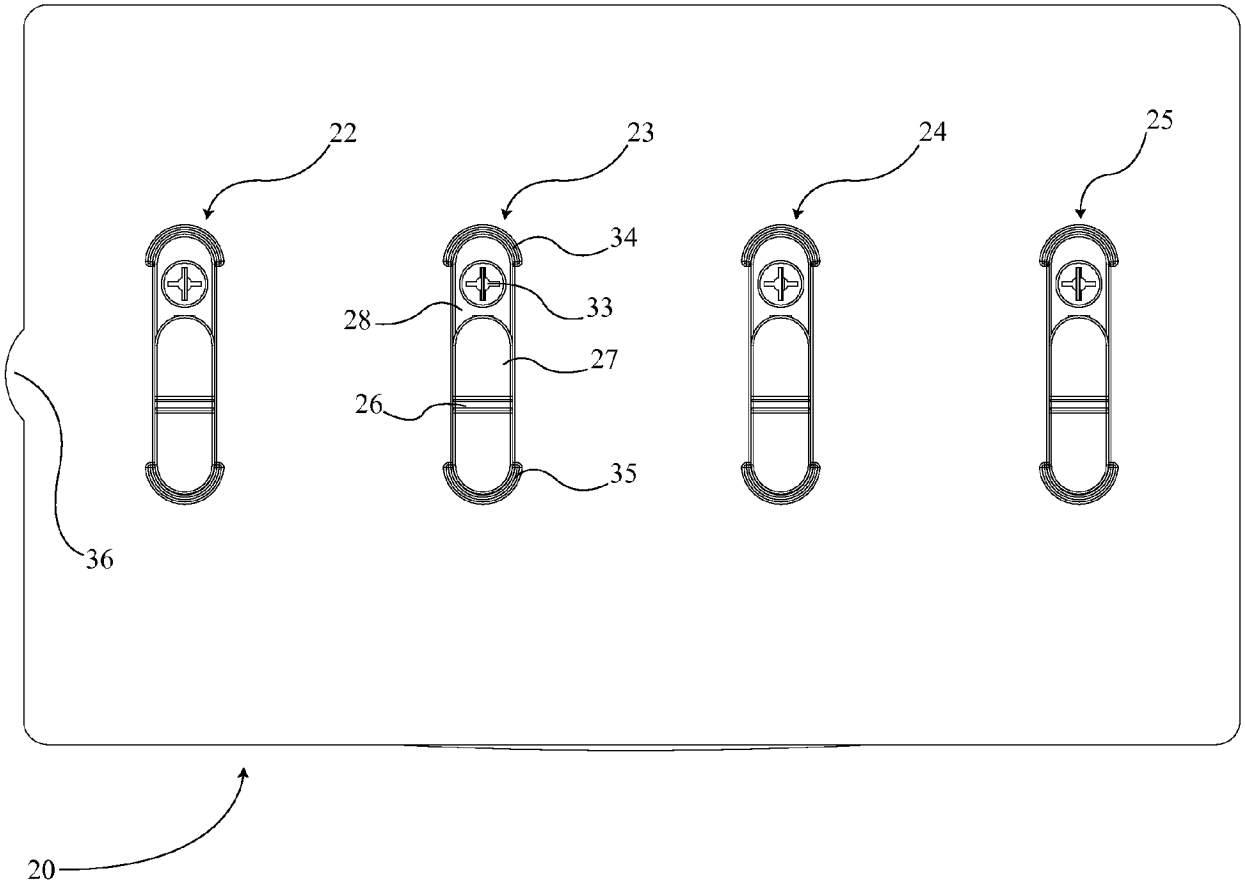
FIG. 6 is a top view of the top lid with the plurality of dispensing mechanisms in the opened position.
Figure 7:
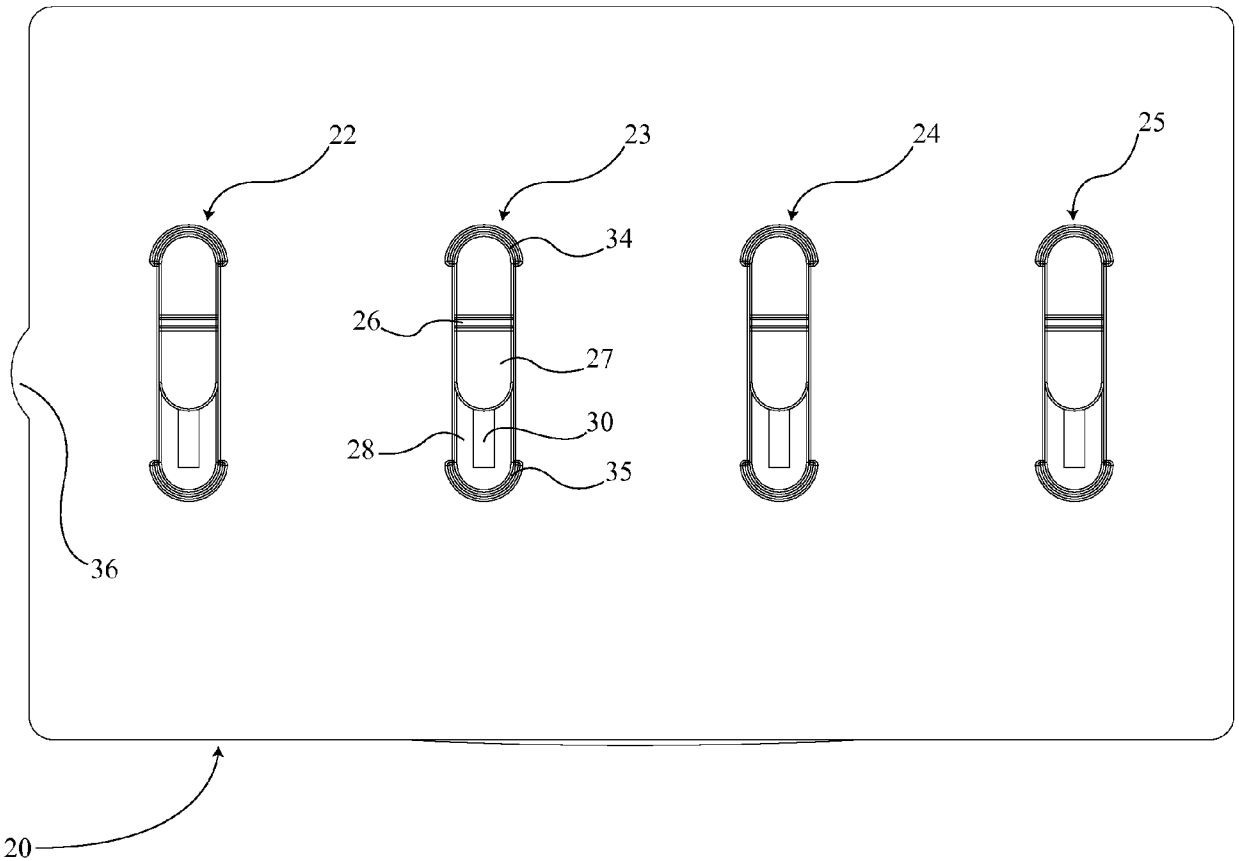
FIG. 7 is a top view of the top lid with the plurality of dispensing mechanisms in the closed position.
Figure 8:
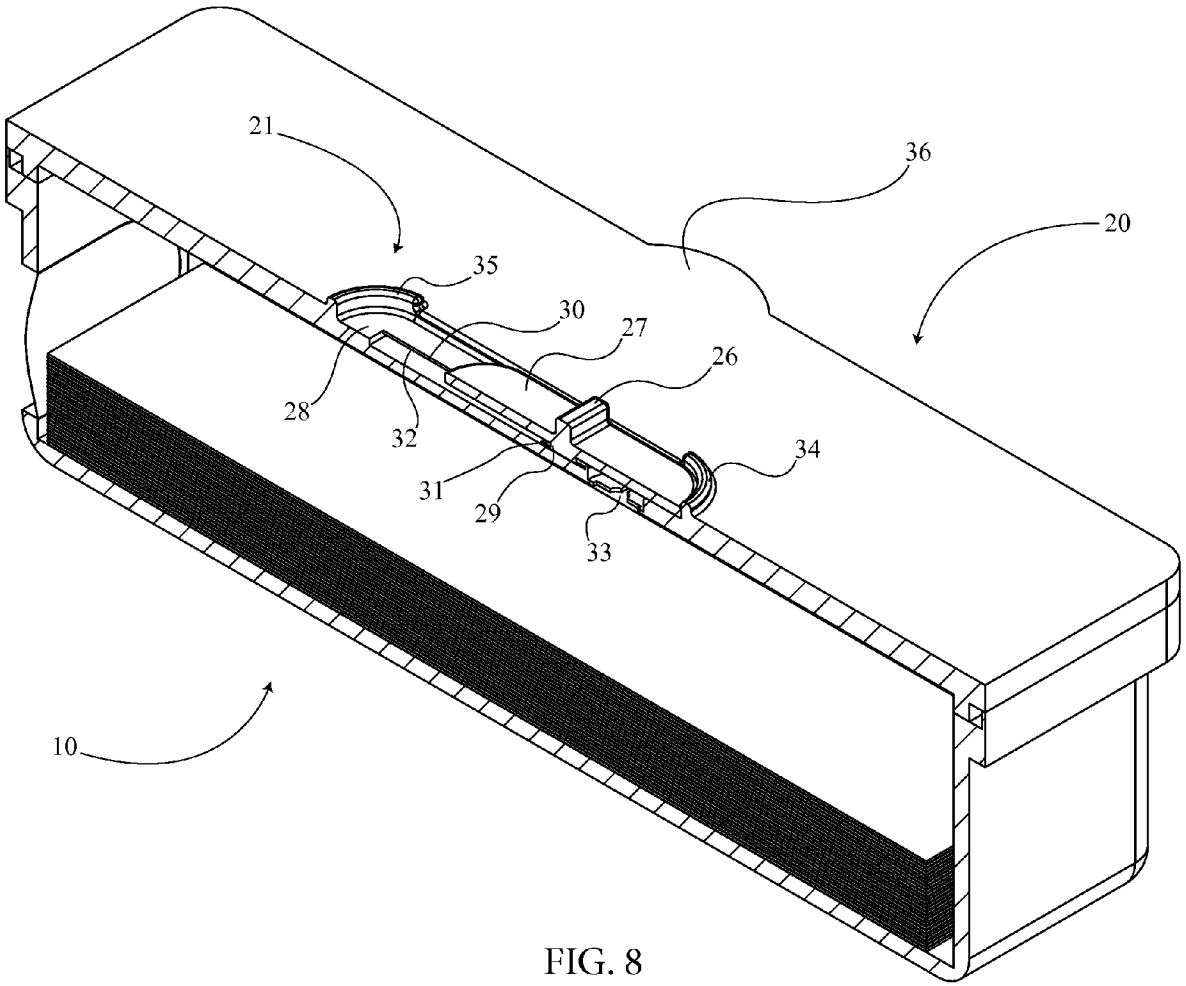
FIG. 8 is a cross-sectional view of the present invention focusing on one of the plurality of dispensing mechanisms.

As can be seen in FIGS. 6 and 7, the plurality of dispensing mechanism 21 allows the user to obtain an individual wash cloth from each of the plurality of wash cloths 1. Each of the plurality of dispensing mechanisms 21 comprises a thumb lip 26, a thumb tab 27, a thumb tab indentation 28, a thumb flap connection 29, a slit 30, a flap 31, a flap cavity 32, a cloth hole 33, a opened stop 34, and a closed stop 35. The components of each individual dispensing mechanism are highlighted in FIG. 8. The thumb tab indentation 28 is a recessed cavity in the top lid 20 and provides a track for the thumb tab 27. The thumb tab 27 moves back and forth along the thumb tab indentation 28 opening and closing the cloth hole 33, which is positioned on one side on the thumb tab indentation 28. The cloth hole 33 is a cross-shaped hole, which applies enough resistance to each of the plurality of wash cloths 1 in order to dispense them individually from the plurality of compartments 12. The thumb lip 26 is perpendicularly positioned at the center of the thumb tab 27 and allows the user to apply the force needed to move the thumb tab 27 back and forth along the thumb tab indentation 28. The thumb tab 27 is connected to the flap 31 by the thumb flap connection 29. The thumb flap connection 29 traverses through the slit 30, while the flap 31 is housed within the flap cavity 32. The flap cavity 32 is positioned below the thumb tab indentation 28 and is shaped to allow the flap 31 to move in the same back and forth motion that the thumb tab 27 does along the thumb tab indentation 28. The slit 30 is also shaped to allow the thumb flap connection 29 to move in the same back and forth motion that the thumb tab 27 does along the thumb tab indentation 28. The purpose of the flap 31 and the thumb flap connection 29 is to provide a means for the thumb tab 27 to stay attached to the top lid 20 without sacrificing its back and forth mobility. The opened stop 34 and the closed stop 35 are protrusions shaped against opposite edges of the thumb tab indentation 28 used to prevent user's finger or thumb from moving too far backwards or forwards while working the thumb tab 27 to open and close the cloth hole 33. The opened stop 34 is positioned adjacent to the thumb tab indentation 28 on the side with the cloth hole 33. The closed stop 35 is positioned adjacent to the thumb tab indentation 28 on the other side opposite to the cloth hole 33.

Although the invention has been explained in relation to its preferred embodiment, it is to be understood that many other possible modifications and variations can be made without departing from the spirit and scope of the invention as hereinafter claimed.

What is claimed is:

1. A compartmentalized portable container and body wash wipes comprises, a plurality of wash cloths;

a bottom container;

a top lid;

said plurality of wash cloths comprises a number of pre-wash cloths, a number of soap cloths, a number of moisturizing cloths, and a number of deodorizing cloths;

said bottom container comprises a plurality of dividers, a plurality of compartments, a bottom surface, a plurality of lateral walls, and a transparent wall;

said top lid comprises a plurality of dispensing mechanisms and a separation tab;

said plurality of compartments comprises a pre-wash cloth compartment, a soap cloth compartment, a moisturizing cloth compartment, and a deodorizing cloth compartment;

said plurality of dispensing mechanisms comprises a pre-wash cloth dispensing mechanism, a soap cloth dispensing mechanism, a moisturizing cloth dispensing mechanism, and a deodorizing cloth mechanism;

each of said plurality of dispensing mechanisms being correspondingly positioned above each of said plurality of compartments;

each of said plurality of dispensing mechanisms comprises a thumb lip, a thumb tab, a thumb tab indentation, a thumb flap connection, a slit, a flap, a flap cavity, a cloth hole, an opened stop, and a closed stop;

said flap being positioned parallel to said thumb tab;

said thumb tab being connected to said flap by said thumb flap connection;

said thumb lip being centrally positioned and perpendicularly connected to said thumb tab opposite to said thumb flap connection;

said thumb tab indentation being positioned on said top lid;

said flap cavity being positioned below thumb tab indentation;

said slit being positioned in between said thumb tab indentation and said flap cavity;

said flap cavity and said slit being located within said top lid;

said flap being housed by said flap cavity;

said slit being traversed by said thumb flap connection;

said thumb tab being surrounded by said thumb tab indentation;

said opened stop being positioned adjacent to said thumb tab indentation;

said closed stop being positioned adjacent to said thumb tab indentation opposite said opened stop; and said cloth hole being positioned on said thumb tab indentation adjacent to said opened stop.

2. The compartmentalized portable container and body wash wipes as claimed in claim 1 comprises, said top lid being situated atop said bottom container; and said plurality of wash cloths being housed by said top lid and said bottom container.

3. The compartmentalized portable container and body wash wipes as claimed in claim 1 comprises, said plurality of pre-wash cloth being saturated in a pre-wash solution, wherein said pre-wash solution contains water and cetyl alcohol;

said plurality of soap cloths being saturated in a soap solution, wherein said soap solution contains water, triethanolamine lauryl sulfate, cocamidopropyl betaine, and propylene glycol;

said plurality of moisturizing cloths being saturated in a moisturizing solution, wherein said moisturizing solution contains citric acid, stearic acid, cocoa butter, glycol stearate, shea butter, collagen, vitamin E, vitamin C, and cetyl alcohol;

said plurality of deodorizing cloths being saturated in a deodorizing solution, wherein said deodorizing solution contains dipropylene glycol, water, propylene glycol, sodium stearate, fragrance, ppg-3 myristyl ether, tetrasodium EDTA, and colors; and wherein the ingredients for the colors is selected from the group consisting of violet 2 and green 6.

4. The compartmentalized portable container and body wash wipes as claimed in claim 1 comprises, said plurality of lateral walls and said transparent wall being positioned perpendicularly to said bottom surface;

said plurality of lateral walls and said transparent wall being connected perpendicularly to said bottom surface;

said plurality of lateral walls, said transparent wall, and said bottom surface being compartmentalized by said plurality of dividers; and said plurality of compartments being shaped by said plurality of lateral walls, said transparent wall, said bottom surface, and said plurality of dividers.

5. The compartmentalized portable container and body wash wipes as claimed in claim 4 comprises, said transparent wall being positioned adjacent to each of said plurality of compartments.

6. The compartmentalized portable container and body wash wipes as claimed in claim 1 comprises, each of said plurality of wash cloths being correspondingly located within each of said plurality of compartments.

7. The compartmentalized portable container and body wash wipes as claimed in claim 6 comprises, said number of pre-wash cloths being located within said pre-wash cloth compartment;

said number of soap cloths being located within said soap cloth compartment;

said number of moisturizing cloths being located within said moisturizing cloth compartment; and said number of deodorizing cloths being located within said deodorizing cloth compartment.

8. The compartmentalized portable container and body wash wipes as claimed in claim 1 comprises, said pre-wash cloth dispensing mechanism being located above said pre-wash cloth compartment;

said soap cloth dispensing mechanism being located above said soap cloth compartment;

said moisturizing cloth dispensing mechanism being located above said moisturizing cloth compartment; and said deodorizing cloth dispensing mechanism being located above said deodorizing cloth compartment.

9. A compartmentalized portable container and body wash wipes comprises, a plurality of wash cloths;

a bottom container;

a top lid;

said plurality of wash cloths comprises a number of pre-wash cloths, a number of soap cloths, a number of moisturizing cloths, and a number of deodorizing cloths;

said bottom container comprises a plurality of dividers, a plurality of compartments, a bottom surface, a plurality of lateral walls, and a transparent wall;

said top lid comprises a plurality of dispensing mechanisms and a separation tab;

said plurality of compartments comprises a pre-wash cloth compartment, a soap cloth compartment, a moisturizing cloth compartment, and a deodorizing cloth compartment;

said plurality of dispensing mechanisms comprises a pre-wash cloth dispensing mechanism, a soap cloth dispensing mechanism, a moisturizing cloth dispensing mechanism, and a deodorizing cloth compartment;

said top lid being situated atop said bottom container;

said plurality of wash cloths being housed by said top lid and said bottom container;

said plurality of lateral walls and said transparent wall being positioned perpendicularly to said bottom surface;

said plurality of lateral walls and said transparent wall being connected perpendicularly to said bottom surface;

said plurality of lateral walls, said transparent wall, and said bottom surface being compartmentalized by said plurality of dividers;

said plurality of compartments being shaped by said plurality of lateral walls, said transparent wall, said bottom surface, and said plurality of dividers;

said transparent wall being positioned adjacent to each of said plurality of compartments;

each of said plurality of dispensing mechanisms being correspondingly positioned above each of said plurality of compartments; and said pre-wash cloth dispensing mechanism being located above said pre-wash cloth compartment;

said soap cloth dispensing mechanism being located above said soap cloth compartment;

said moisturizing cloth dispensing mechanism being located above said moisturizing cloth compartment; and said deodorizing cloth dispensing mechanism being located above said deodorizing cloth compartment;

each of said plurality of dispensing mechanisms comprises a thumb lip, a thumb tab, a thumb tab indentation, a thumb flap connection, a slit, a flap, a flap cavity, a cloth hole, an opened stop, and a closed stop;

said flap being positioned parallel to said thumb tab;

said thumb tab being connected to said flap by said thumb flap connection;

said thumb lip being centrally positioned and perpendicularly connected to said thumb tab opposite to said thumb flap connection;

said thumb tab indentation being positioned on said top lid;

said flap cavity being positioned below thumb tab indentation;

said slit being positioned in between said thumb tab indentation and said flap cavity;

said flap cavity and said slit being located within said top lid;

said flap being housed by said flap cavity;

said slit being traversed by said thumb flap connection;

said thumb tab being surrounded by said thumb tab indentation;

said opened stop being positioned adjacent to said thumb tab indentation;

said closed stop being positioned adjacent to said thumb tab indentation opposite said opened stop; and said cloth hole being positioned on said thumb tab indentation adjacent to said opened stop.

10. The compartmentalized portable container and body wash wipes as claimed in claim 9 comprises, said plurality of pre-wash cloth being saturated in a pre-wash solution, wherein said pre-wash solution contains water and cetyl alcohol;

said plurality of soap cloths being saturated in a soap solution, wherein said soap solution contains water, triethanolamine lauryl sulfate, cocamidopropyl betaine, and propylene glycol;

said plurality of moisturizing cloths being saturated in a moisturizing solution, wherein said moisturizing solution contains citric acid, stearic acid, cocoa butter, glycol stearate, shea butter, collagen, vitamin E, vitamin C, and cetyl alcohol;

said plurality of deodorizing cloths being saturated in a deodorizing solution, wherein said deodorizing solution contains dipropylene glycol, water, propylene glycol, sodium stearate, fragrance, ppg-3 myristyl ether, tetrasodium EDTA, and colors; and wherein the ingredients for the colors is selected from the group consisting of violet 2 and green 6.

11. The compartmentalized portable container and body wash wipes as claimed in claim 9 comprises, each of said plurality of wash cloths being correspondingly located within each of said plurality of compartments;

said number of pre-wash cloths being located within said pre-wash cloth compartment;

said number of soap cloths being located within said soap cloth compartment;

said number of moisturizing cloths being located within said moisturizing cloth compartment; and said number of deodorizing cloths being located within said deodorizing cloth compartment.

12. A compartmentalized portable container and body wash wipes comprises, a plurality of wash cloths;

a bottom container;

a top lid;

said plurality of wash cloths comprises a number of pre-wash cloths, a number of soap cloths, a number of moisturizing cloths, and a number of deodorizing cloths;

said bottom container comprises a plurality of dividers, a plurality of compartments, a bottom surface, a plurality of lateral walls, and a transparent wall;

said top lid comprises a plurality of dispensing mechanisms and a separation tab;

said plurality of compartments comprises a pre-wash cloth compartment, a soap cloth compartment, a moisturizing cloth compartment, and a deodorizing cloth compartment;

said plurality of dispensing mechanisms comprises a pre-wash cloth dispensing mechanism, a soap cloth dispensing mechanism, a moisturizing cloth dispensing mechanism, and a deodorizing cloth compartment;

said plurality of pre-wash cloth being saturated in a pre-wash solution, wherein said pre-wash solution contains water and cetyl alcohol;

said plurality of soap cloths being saturated in a soap solution, wherein said soap solution contains water, triethanolamine lauryl sulfate, cocamidopropyl betaine, and propylene glycol;

said plurality of moisturizing cloths being saturated in a moisturizing solution, wherein said moisturizing solution contains citric acid, stearic acid, cocoa butter, glycol stearate, shea butter, collagen, vitamin E, vitamin C, and cetyl alcohol;

said plurality of deodorizing cloths being saturated in a deodorizing solution, wherein said deodorizing solution contains dipropylene glycol, water, propylene glycol, sodium stearate, fragrance, ppg-3 myristyl ether, tetrasodium EDTA, and colors;

wherein the ingredients for the colors is selected from the group consisting of violet 2 and green 6;

each of said plurality of dispensing mechanisms being correspondingly positioned above each of said plurality of compartments;

each of said plurality of dispensing mechanisms comprises a thumb lip, a thumb tab, a thumb tab indentation, a thumb flap connection, a slit, a flap, a flap cavity, a cloth hole, an opened stop, and a closed stop;

said flap being positioned parallel to said thumb tab;

said thumb tab being connected to said flap by said thumb flap connection;

said thumb lip being centrally positioned and perpendicularly connected to said thumb tab opposite to said thumb flap connection;

said thumb tab indentation being positioned on said top lid;

said flap cavity being positioned below thumb tab indentation;

said slit being positioned in between said thumb tab indentation and said flap cavity;

said flap cavity and said slit being located within said top lid;

said flap being housed by said flap cavity;

said slit being traversed by said thumb flap connection;

said thumb tab being surrounded by said thumb tab indentation;

said opened stop being positioned adjacent to said thumb tab indentation;

said closed stop being positioned adjacent to said thumb tab indentation opposite said opened stop; and said cloth hole being positioned on said thumb tab indentation adjacent to said opened stop.

13. The compartmentalized portable container and body wash wipes as claimed in claim 12 comprises, said top lid being situated atop said bottom container;

said plurality of wash cloths being housed by said top lid and said bottom container;

said plurality of lateral walls and said transparent wall being positioned perpendicularly to said bottom surface;

said plurality of lateral walls and said transparent wall being connected perpendicularly to said bottom surface;

said plurality of lateral walls, said transparent wall, and said bottom surface being compartmentalized by said plurality of dividers;

said plurality of compartments being shaped by said plurality of lateral walls, said transparent wall, said bottom surface, and said plurality of dividers; and said transparent wall being positioned adjacent to each of said plurality of compartments.

14. The compartmentalized portable container and body wash wipes as claimed in claim 12 comprises, each of said plurality of wash cloths being correspondingly located within each of said plurality of compartments;

said number of pre-wash cloths being located within said pre-wash cloth compartment;

said number of soap cloths being located within said soap cloth compartment;

said number of moisturizing cloths being located within said moisturizing cloth compartment; and said number of deodorizing cloths being located within said deodorizing cloth compartment.

15. The compartmentalized portable container and body wash wipes as claimed in claim 12 comprises, said pre-wash cloth dispensing mechanism being located above said pre-wash cloth compartment;

said soap cloth dispensing mechanism being located above said soap cloth compartment;

said moisturizing cloth dispensing mechanism being located above said moisturizing cloth compartment; and said deodorizing cloth dispensing mechanism being located above said deodorizing cloth compartment.

* * * * *